US007600862B2

(12) United States Patent
Umeda

(10) Patent No.: US 7,600,862 B2
(45) Date of Patent: Oct. 13, 2009

(54) INKJET RECORDING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 461 days.

(21) Appl. No.: 11/475,036

(22) Filed: Jun. 27, 2006

(65) Prior Publication Data

US 2007/0019045 A1 Jan. 25, 2007

(30) Foreign Application Priority Data

Jun. 30, 2005 (JP) ..... 2005-191952

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/85

See application file for complete search history.

(56) References Cited

U.S. PATENT DOCUMENTS 4,038,667 A 7/1977 Hou et al.
4,833,491 A 5/1989 Rezanka
6,231,174 B1 5/2001 Haigo
6,386,689 B1 * 5/2002 Sasada ..... 347/85
2004/0085416 A1 5/2004 Kent
2005/0253907 A1 * 11/2005 Otis et al. ..... 347/85
2006/0001715 A1 1/2006 Umeda et al.

FOREIGN PATENT DOCUMENTS

JP H2111555 4/1990

OTHER PUBLICATIONS

European Patent Office, European Search Report for Related EP Application No. 06253401 dated Jun. 15, 2007.

* cited by examiner

*Primary Examiner*—Stephen D Meier
*Assistant Examiner*—Carlos A Martinez, Jr.
(74) *Attorney, Agent, or Firm*—Baker Botts L.L.P.

(57) ABSTRACT

To prevent evaporation of the solvent in an ink from an ink supply tube and reduce the increase in the viscosity of color inks when a selected mode is switched to a facsimile mode, withdrawal-driving of pumps corresponding to the respective color inks is performed to withdraw the inks in the respective colors into ink cartridges from the respective ink supply tubes. Then, when performing color image recording in a printer mode again, color image recording is started by performing supply-driving of the pumps corresponding to the respective color inks to introduce the respective color inks into the ink supply tubes from the ink cartridges corresponding to the respective colors.

22 Claims, 10 Drawing Sheets

INKJET RECORDING APPARATUS

CROSS-REFERENCE TO RELATED APPLICATION

This non-provisional application claims priority under 35 U.S.C. §119(a) on Patent Application No. 2005-191952 filed in Japan on Jun. 30, 2005, the entire contents of which are hereby incorporated by reference.

BACKGROUND

The present invention relates to an inkjet recording apparatus, and particularly relates to a technique for reducing the increase in the viscosity of an ink in an ink supply tube for supplying the ink to a recording head.

In a conventional inkjet recording apparatus, there is the possibility of a phenomenon in which ejection of the ink from a nozzle may be impossible due to an increase in the viscosity of the ink or solidification of the ink caused by drying, or intrusion of foreign objects. Therefore, the conventional inkjet recording apparatus is provided with functions for maintaining and recovering the ejection function of the nozzle by forcefully ejecting or sucking the ink from the nozzle.

On the other hand, as an inkjet recording apparatus of this type, there is a known tube-supply-type inkjet recording apparatus that supplies an ink to a recording head mounted on a movable carriage from an ink cartridge fixed in the main body through a flexible ink supply tube. In such a tube-supply-type inkjet recording apparatus, it was recognized that the viscosity of the ink increases when a solvent in the ink residing in the ink supply tube permeates the ink supply tube and evaporates (see Japanese Patent Application Laid-Open No. H2-111555 (1990)).

By the way, in recent years, there are inkjet recording apparatuses having a facsimile function in addition to a printer function, such as an inkjet printer disclosed in Japanese Patent Application Laid-Open No. 2004-255861.

In a printer having such a facsimile function, in general, there is a tendency that black ink is often used and other color inks (for example, cyan; magenta and yellow) are not used as frequently as black ink because of its applications. Thus, in a tube-supply-type inkjet recording apparatus, if there is a difference in the frequency of use of inks depending on colors, an ink which is used less frequently may stay in the ink supply tube for a long time. Then, if the ink stays in a long time, the amount of the solvent evaporated from the ink increases accordingly, and the viscosity of the ink is apt to increase. Therefore, in order to maintain and recover the ejection function of the nozzle, even when an ink is not used for recording, it is necessary to forcefully discharge and discard the ink by performing a maintenance operation periodically, and the user is caused to bear an ineffective burden for the ink consumption.

In order to prevent the above-mentioned increase in the viscosity of the ink in the ink supply tube, Japanese Patent Application Laid-Open No. H2-111555 (1990) discloses a technique for reducing the evaporation of the solvent by providing the ink supply tube with a multi-layer structure.

SUMMARY

However, the cost of the ink supply tube with a multi-layer structure as disclosed in Japanese Patent Application Laid-Open No. H2-111555 (1990) is higher compared to normal ink supply tubes without special function for preventing evaporation of the solvent in the ink, such as a tube with a single-layer structure. Moreover, since the ink supply tube is frequently bent in a repeated manner according to the movement of the carriage, the ink supply tube with a multi-layer structure has concerns about rigidity and durability due to its structure as compared to an ink supply tube with a single-layer structure.

In order to solve the above problems, it is an object to provide an inkjet recording apparatus that can reduce the increase in the viscosity of the ink in an ink supply tube even if the ink supply tube is a normal low-cost ink supply tube, and can consequently reduce the wasteful ink consumption caused by maintenance operations.

An inkjet recording apparatus according to claim 1, which was invented to solve the above problems, is characterized in that, when image recording using an ink in a color is not performed, the ink is withdrawn from the ink supply tube.

More specifically, the above-mentioned inkjet recording apparatus is an inkjet recording apparatus, comprising: a plurality of ink tanks for storing inks in a plurality of colors respectively; a plurality of sub-ink tanks for storing the inks supplied from the ink tanks respectively; a plurality of recording heads incorporating the sub-ink tanks respectively, and each for recording an image on a recording medium by ejecting the ink from a nozzle; a plurality of ink supply tubes for connecting the ink tanks and the recording heads respectively; a liquid feeding unit provided in a middle of the ink supply tubes and capable of feeding each ink in both of a direction of supplying each ink from each ink tank to each ink supply tube and each sub-ink tank and a direction of withdrawing each ink from each ink supply tube into each ink tank; and a controller capable of; when image recording using an ink in a color is not performed, causing the liquid feeding unit to withdraw the ink into the ink tank from the ink supply tube for supplying the ink, and, when image recording is to be performed using the ink, causing the liquid feeding unit to introduce the ink from the ink tank into the ink supply tube for supplying the ink, thereafter causing the recording head to start image recording.

The inkjet recording apparatus having such a structure may be an inkjet recording apparatus for performing mono-color image recording using an ink in one color, or an inkjet recording apparatus capable of performing multi-color image recording using inks in a plurality of colors.

According to the inkjet recording apparatus thus constructed, when image recording using an ink in a color is not performed, the ink is withdrawn from the ink supply tube, and thus it is possible to prevent evaporation of the solvent in the ink from the ink supply tube. In other words, even when the ink supply tube is a low-cost ink supply tube without a special function for preventing evaporation of the solvent in the ink, it is possible to reduce the increase in the viscosity of the ink in the ink supply tube. Moreover, if the ink has been withdrawn from the ink supply tube, even when the ink is discharged due to a maintenance operation on the recording head, the ink will not be newly supplied to the recording head, and consequently it impossible to reduce the amount of the ink discarded.

Further, since it is possible to reduce the increase in the viscosity of an ink in an ink supply tube, the amount of an ink to be discarded may be reduced by not performing a maintenance operation on the recording head corresponding to the ink, or decreasing the number of times the maintenance operation is performed, if the ink has been withdrawn from the ink supply tube.

The above and further objects and features will more fully be apparent from the following detailed description with accompanying drawings.

DETAILED DESCRIPTION OF THE EXEMPLARY EMBODIMENTS

The following description will explain an embodiment based on the drawings.

[Explanation of Overall Structure of Inkjet Recording Apparatus 1]

Figure 1:
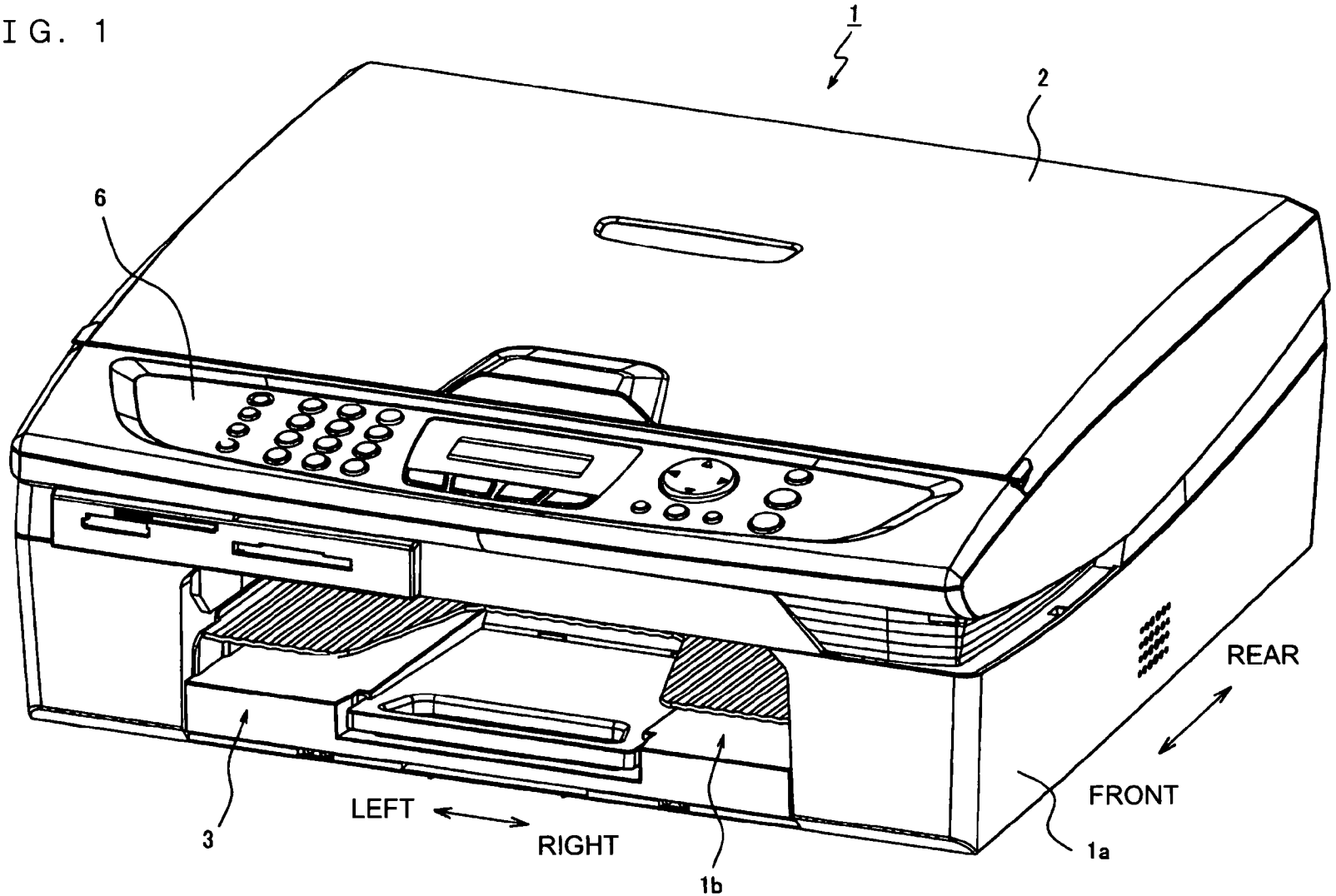
FIG. 1 is an external perspective view of an inkjet recording apparatus 1 suitable for an application of this embodiment.
Figure 2:
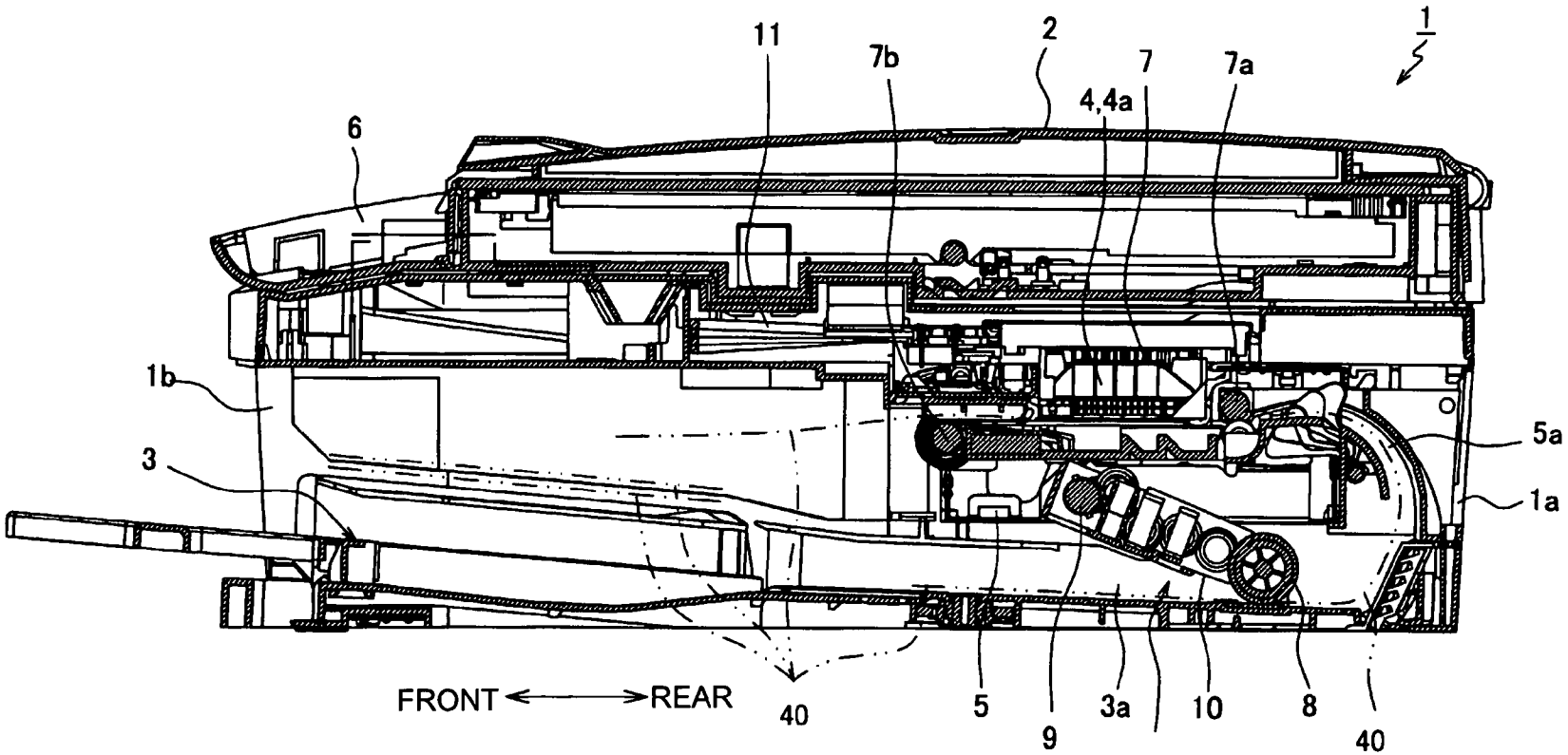
FIG. 2 is a cross sectional view of the inkjet recording apparatus 1.

FIG. 1 is an external perspective view of an inkjet recording apparatus 1 suitable for applying this embodiment. FIG. 2 is a cross sectional view of the inkjet recording apparatus 1.

The inkjet recording apparatus is a so-called multi function device (MFD) having a printer function, a copy function, a scanner function, a facsimile function, etc., and uses a sheet of paper (recording paper), such as paper or plastic film, as a recording medium. In this inkjet recording apparatus 1, it is possible to perform monochrome image recording with the facsimile function, and perform color and monochrome image recording with the printer function and the copy function.

As shown in FIGS. 1 and 2, the inkjet recording apparatus 1 has a scanner 2 in the upper part of a case 1*a*, and a recording unit 7 under the scanner 2 (in the upper part in the case 1*a*) for performing recording, (image formation) on a recording paper 40 with the above-mentioned various functions. A paper feeder 30 is provided in the lower part in the case 1*a*.

A box-type metal frame 5 is placed above the paper feeder 30 in the rear part in the case 1*a*. The frame 5 has a substantially rectangular parallelepiped shape elongated in the left-right direction, and is fixed in the case 1*a*.

The recording unit 7 is positioned in the upper part in the frame 5. The recording unit 7 comprises a carriage 4*a*, which carries a recording head 4 for performing image recording and is movable to the left and right (in the main scanning direction) reciprocally, and other mechanism. In this recording unit 7, when the carriage 4*a* is controlled by a controller 110 composed of a CPU, etc. (not shown in FIG. 2, but see FIG. 6) to move to the left and right reciprocally, the recording head 4 is also scanned. By ejecting an ink from the nozzle during the scanning, the recording head 4 records an image on the recording paper 40 stopped under the recording head 4.

Moreover, a maintenance unit (not shown) is mounted at a position corresponding to a standby position of the carriage 4*a* in the recording unit 7. The maintenance unit performs various maintenance operations, such as a wiping operation for wiping the nozzle surface of the recording head 4 with a blade, etc., a purge operation and a flushing operation for forcefully removing dust and the air and further the solidified ink from the inside of the nozzle.

Located in the front part in the case la are four ink cartridges 13 (not shown in FIG. 2 but see FIGS. 3A and 3B) storing inks in four colors (black, cyan, magenta and yellow), respectively, for full-color image recording. These ink cartridges 13 are detachable, and a whole ink cartridge 13 is replaced when replenishing the ink cartridge 13 with the ink.

The inks stored in the respective ink cartridges 13 are supplied to the recording heads 4 through four ink supply tubes 11 connecting the respective ink cartridges 13 and the recording heads 4 together. These ink supply tubes 11 are supported so that they can move according to the reciprocal movement of the carriage 4*a*.

Formed in the rear part of the frame 5 is a transport path 5*a* for guiding the recording paper 40 from the rear part of the paper feeder 30 to the recording unit 7. The recording unit 7 has a transport roller 7*a* at a position adjacent to the exit of the transport path 5*a*, and a discharge roller 7*b* at a position where the recording paper 40 on which an image has been recorded is discharged. The transport roller 7*a* rotates upon receipt of a rotation drive force of a paper transport motor 123 (not shown in FIG. 2, but see FIG. 6).

The paper feeder 30 includes a paper feed cassette 3 which is inserted and set from an opening 1*b* in the case 1*a*. The paper cassette 3 has a paper storage section 3*a* for storing a stack of the recording paper 40. When the paper cassette 3 is inserted into the case 1*a*, the recoding paper 40 in the paper storage section 3*a* is positioned in the rear part in the case 1*a*.

With a rotation of a paper feed roller 8, the top most sheet of the recording paper 40 stacked in the paper storage section 3*a* is sent to the recording unit 7 through the transport path 5*a*. The paper feed roller 8 is rotatably held on an end of a long arm 10 supported with a driving shaft 9. When the driving shaft 9 rotates upon receipt of a rotation drive force of a paper feed motor 122 (not shown in FIG. 2, but see FIG. 6), the rotation is transmitted to the paper feed roller 8, and the paper feed roller 8 rotates.

Moreover, an operation panel 6 including various operation buttons and a liquid crystal panel is provided on the upper front face of the inkjet recording apparatus 1. With this operation panel 6, the user can select each of the modes, such as a printer mode, a copy mode, a scanner mode and a facsimile mode, of the inkjet recording apparatus 1, can set various setting items in various modes, can enter necessary items such as a facsimile number, and can confirm the operation status; the communication history, etc.

[Explanation of Ink Supply Mechanism]

Figure 3B:
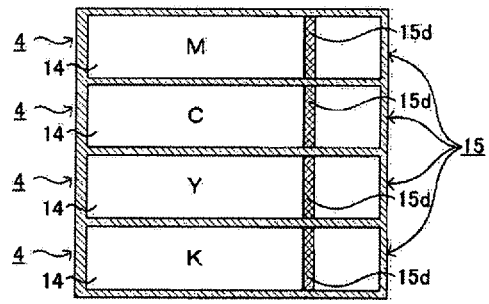
FIG. 3B is a view showing schematically a cross section of a recording head 4 seen from above.
Figure 3A:
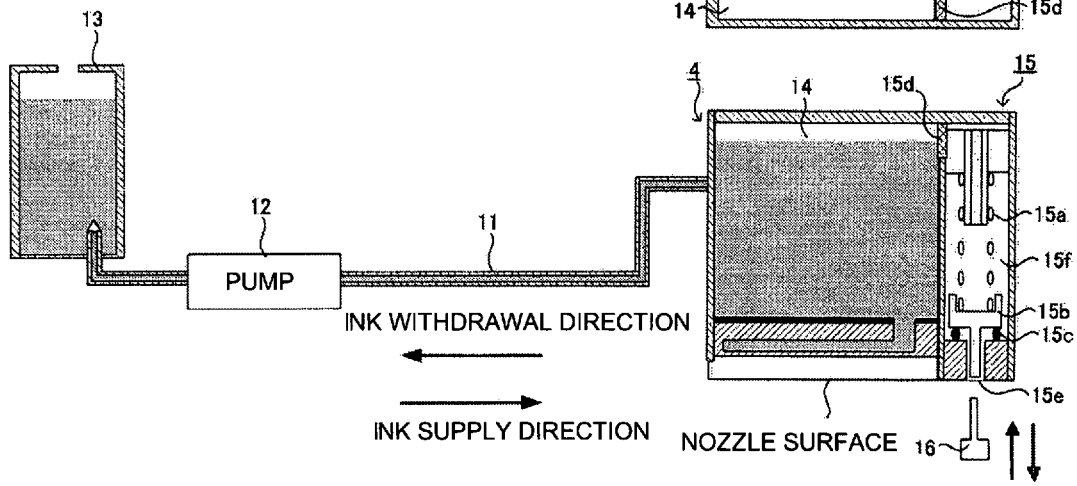
FIG. 3A is a view showing schematically a side section of an ink supply mechanism of the inkjet recording apparatus 1.

FIGS. 3A and 3B are explanatory views showing the schematic structure of the ink supply mechanism of the inkjet recording apparatus 1, wherein FIG. 3A is a view showing schematically a side section of the ink supply mechanism and FIG. 3B is a view showing schematically a cross section of the recording head 4 seen from above.

The inkjet supply mechanism is a mechanism for supplying inks to four recordings heads 4 (see FIG. 3B), which are mounted on the carriage 4*a* in the recording unit 7 and correspond to magenta (M), cyan (C), yellow (Y), and black (K)

inks, respectively, from the corresponding ink cartridges 13. As shown in FIG. 3A, sub-tanks 14 provided in the recording heads 4 corresponding to the inks in the respective colors and the ink cartridges 13 of the inks in the respective color are connected through ink supply tubes 11 and pumps 12 provided in the middle of the ink supply tubes 11. In other words, the ink supply tubes 11 and the pumps 12 are provided corresponding to the respective four recording heads 4.

The recording head 4 includes a sub-tank 14 for storing the ink ejected from the nozzle provided in the nozzle surface located in the lower part thereof, and a valve section 15 for opening or closing the sub-tank 14 to the atmosphere. The sub-tank 14 and the valve section 15 are connected through a gas permeable film 15*d* as a selective permeable film that allows the air to permeate therethrough; but does not allow the ink to permeate therethrough. Thus, when the sub-tank 14 is opened to the atmosphere by the valve section, only the air flows between the sub-tank 14 and the valve section 15, and the ink does not leak from the sub-tank 14 to the valve section 15.

The valve section 15 comprises an upper large-diameter section 15*f* and a lower small-diameter air vent 15*e*, and a valve 15*b* constructed by integrally forming a large-diameter valve element and a small-diameter rod is stored in the large-diameter section 15*f* so that it can be moved up and down. Moreover, a packing 15*c* as a sealing O ring is interposed between the lower-end surface of the valve element of the valve 15*b* and the upper-end surface of an air vent 15*e*. The valve 15*b* is always pressed down by a spring 15*a*, such as a coil spring, provided in the large-diameter section 15*f*. In this state, the packing 15*c* is pressed by the valve element of the valve 15*b* and the spring 15*a*, and the valve 15*b* is brought into a closed state. At this time, the rod of the valve 15*b* is extended to the vicinity of the lower-end opening of the air vent 15*e*. On the other hand, when a release rod 16 located in the standby position of the recording head 4 or the like is raised and pushes up the rod of the valve 15*b* against the energizing force of the spring 15*a*, the valve element of the valve 15*b* separates from the packing 15*c*, and the value 15*b* is brought into an open state, namely a state opened to the atmosphere.

The pump 12 is provided in the middle of the ink supply tube 11. The pump 12 is a pump capable of feeding an ink in two directions, namely a direction of supplying the ink from the ink cartridge 13 to the sub-tank 14 of the recording head 4 (hereinafter referred to as the "ink supply direction") and a direction of returning the ink from the sub-tank 14 to the ink cartridge 13 (hereinafter referred to as the "ink withdrawal direction").

Figure 4A:
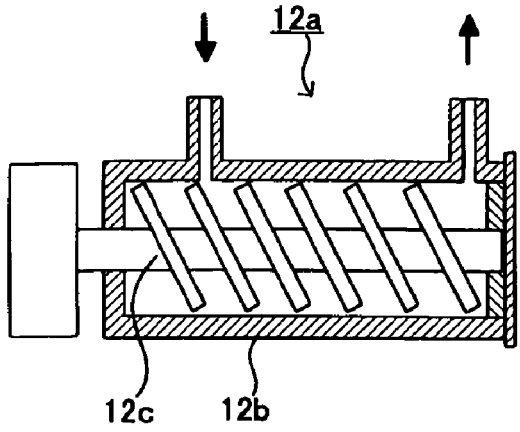
FIG. 4A is a view showing a schematic structure of a screw pump 12*a* as a specific example of a pump 12.
Figure 4B:
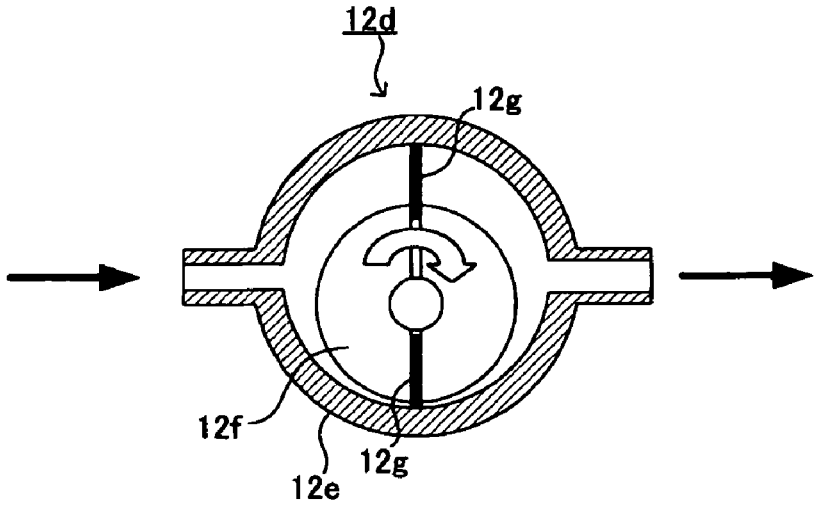
FIG. 4B is a view showing a schematic structure of a vane pump 12*d* as a specific example of a pump 12.

FIGS. 4A and 4B are views showing specific examples of the pump 12, wherein FIG. 4A shows the schematic structure of a screw pump 12*a*, and FIG. 4B is a view showing the schematic structure of a vane pump 12*d*.

In the screw pump 12*a*, as shown in FIG. 4A, by rotating a screw-type rotor 12*c* in contact with the inside of a casing 12*b*, the ink fills the gap between the screw thread of the screw-type rotor 12*c* and the internal wall of the casing 12*b* and is fed in the axial direction, thereby functioning as a pump. On the other hand, in the vane pump 12*d*, as shown in FIG. 4B, plate-like vanes 12*g* freely enter into and exist from grooves provided radially in a rotor 12*f* in a radial direction of the rotor 12*f*. With a rotation of the rotor 12*f*, the vane 12*g* extends outward in a radial direction of the rotor 12*f* due to a centrifugal force, and the tip of the vane 12*g* comes into contact with the inner surface of the casing 12*e* and slides according to the rotation of the rotor 12*f*. With the rotation of the rotor 12*f*, the size of a chamber enclosed by the vanes 12*g*, rotor 12*f* and casing 12*e* expands or shrinks, thereby functioning as a pump. Note that in the inkjet recording apparatus 1 of this embodiment, it may be possible to use either the screw pump 12*a* or the vane pump 12*d* as a pump 12 for feeding the ink.

Figure 5A:
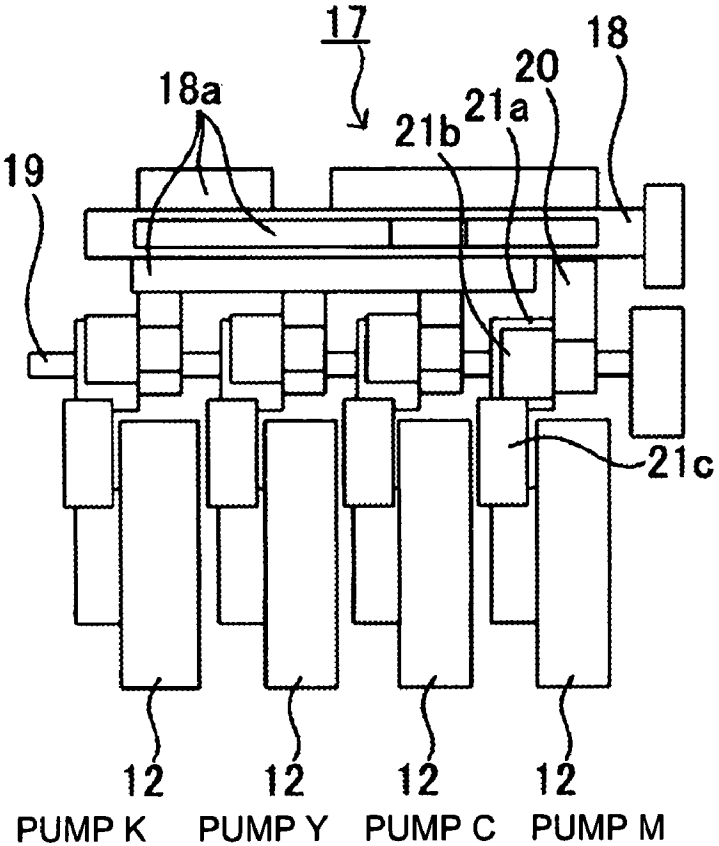
FIGS. 5A to 5C are views showing a schematic structure of a pump drive switching mechanism 17.
Figure 5B:
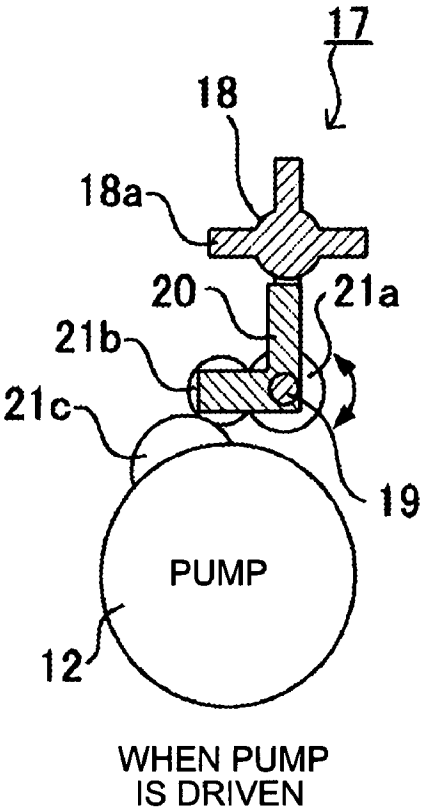
Figure 5C:
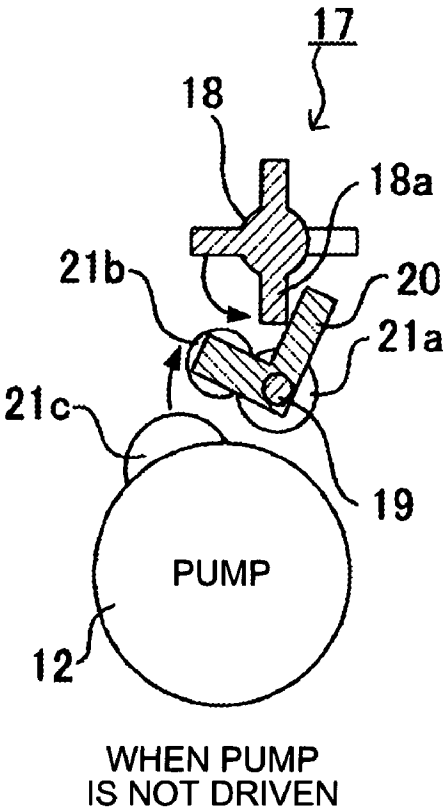

FIGS. 5A to 5C are views showing a schematic structure of a pump drive switching mechanism 17. The pump drive switching mechanism 17 is for selectively driving each of the pumps 12 corresponding to the K, Y, C, and M inks, respectively.

As shown in FIG. 5A, the pump drive switching mechanism 17 comprises a drive switching gear 18 for switching the connection of drive force to the pumps 12 for the K, Y, C and M inks, a pump driving shaft 19 rotated by the operation of a pump drive motor 23 (not shown in FIGS. 5A to 5C, but see FIG. 6), a gear support member 20 supported rotatably with the pump driving shaft 19, a driving shaft gear 21*a* connected to the pump driving shaft 19, an intermediate gear 21*b* supported on one end of the gear support member 20 by a shaft and engaged with the driving shaft gear 21*a*, and a pump-side gear 21*c* for driving the pump 12. A series of structures including the gear support member 20, the driving shaft gear 21*a*, the intermediate gear 21*b* and the pump-side gear 21*c* is provided for each of the pumps 12 corresponding to inks in the respective colors. Further, each gear support member 20 is always energized in a direction of engaging the intermediate gear 21*b* with the pump-side gear 21*c*.

Figure 6:
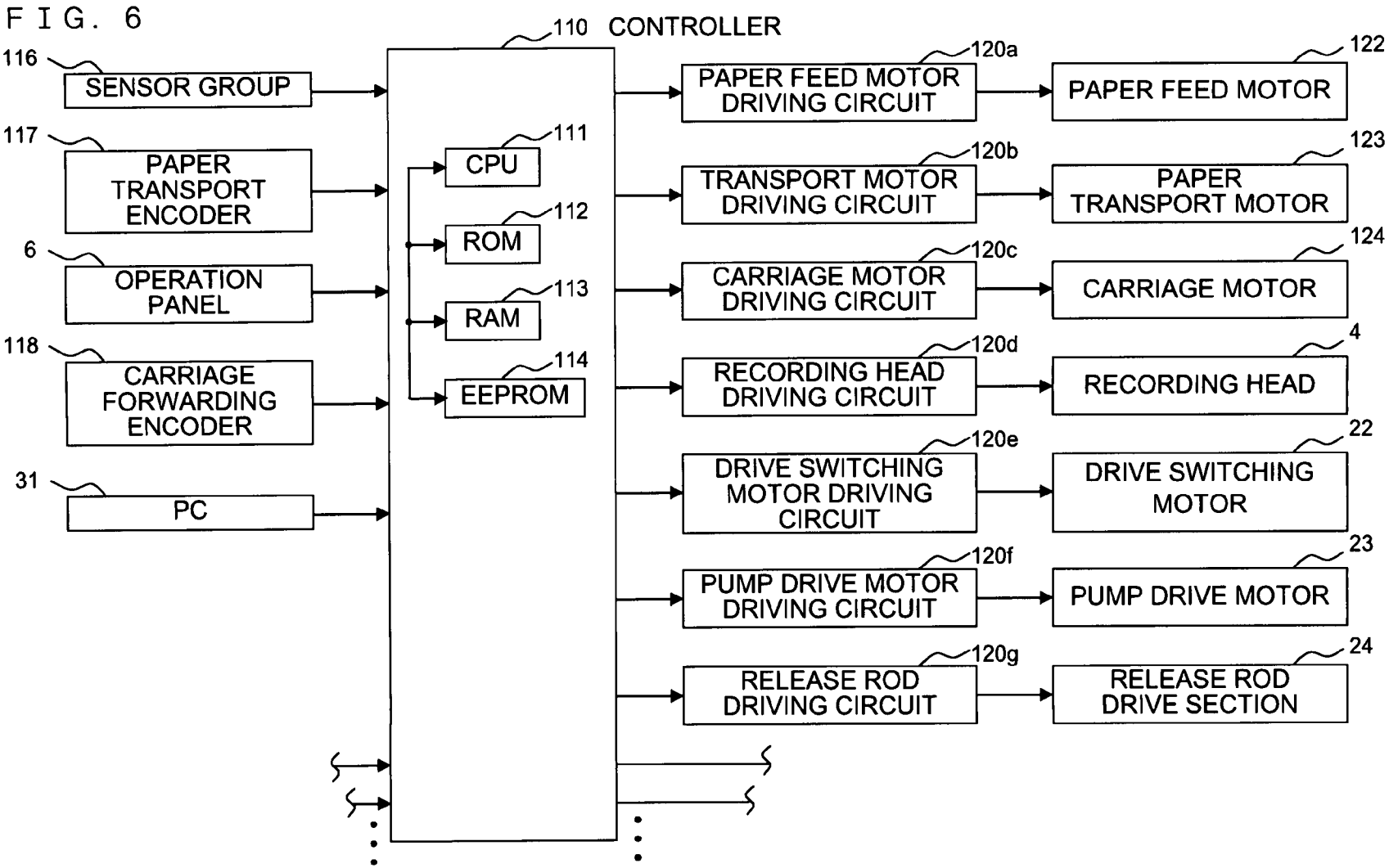
FIG. 6 is a block diagram showing an electrical structure of the inkjet recording apparatus 1.

The drive switching gear 18 is rotated by the operation of the drive switching motor 22 such as a stepping motor (not shown in FIGS. 5A to 5C, but see FIG. 6). On this drive switching gear 18, strip teeth 18*a*, which come into engagement with the other end of the respective gear support members 20 located below when the drive switching gear 18 is rotated, are provided radially in four directions at an interval of 90°. Further, in each of the teeth 18*a* in the respective directions, a notch is provided at mutually different position so as not to engage with the gear support member 20 corresponding to each tooth 18*a* on a one-to-one basis. In other words, by rotating the drive switching gear 18 by a predetermined amount (90°) at a time, one pump to be driven can be selected by the function of each tooth 18*a* provided on the drive switching gear 18 and its notch.

More specifically, as shown in FIG. 5B, when the notch of the tooth 18*a* is located on the lower side, the gear support member 20 corresponding to this notch presses the intermediate gear 21*b* towards the pump-side gear 21*c*, and the intermediate gear 21*b* engages with the pump-side gear 21*c*. Therefore, the driving shaft gear 21*a*, the intermediate gear 21*c* and the pump-side gear 21*c* are engaged with each other. At this time, the rotation of the pump driving shaft 19 that rotates in response to the driving of the pump driving motor 23 is transmitted to the pump-side gear 21*c* through the driving shaft gear 21*a* connected to the pump driving shaft 19 and the intermediate gear 21*b*, the pump-side gear 21*c* rotates, and consequently the pump 12 is driven.

On the other hand, as shown in FIG. 5C (FIG. 5C shows a state in which the drive switching gear 18 is rotated in a counter clockwise direction by only 90° from the state shown in FIG. 5B), in a state in which the tooth 18*a* is rotated to the lower side and engaged with the other end of the gear support member 20, the gear support member 20 rotates round the pump driving shaft 19 against the energizing force (in the clockwise direction in FIG. 5C), and the engaged pump-side gear 21*c* and intermediate gear 21*b* supported on one end of the gear support member 20 by the shaft are separated from each other. At this time, the rotation of the pump driving shaft 19 is not transmitted to the pump side gear 21*c*, and thus the pump 12 is not driven.

With the pump drive switching mechanism 17, it is possible to drive each pump 12 in both the forward and reverse directions, that is, it is possible to feed the ink in two directions of the ink supply direction and ink withdrawal direction, by switching the rotation direction of the pump drive motor between the forward and reverse directions.

[Electrical Structure of Inkjet Recording Apparatus 1]

Here, the electrical structure of the inkjet recording apparatus 1 will be explained with reference to the block diagram of FIG. 6.

As shown in FIG. 6, the inkjet recording apparatus 1 comprises a controller 110 including a CPU 111, a ROM 112, and a RAM 113, and an EEPROM 114.

The controller 110 is electrically connected to a sensor group 116 composed of various sensors such as known media sensors and resist sensors capable of detecting the presence or absence of recording paper 40, the front end, the rear end and the edges in the width direction of recording paper 40, etc., a paper transport encoder 117 for detecting the transport amount (position) of the recording paper 40, an operation panel 6, a carriage forwarding encoder 118, etc.

In addition to the input from the operation panel 6, the inkjet recording apparatus 1 is connected, for example, to a personal computer (PC) 31, and can also record an image or a document on the recording paper 40 based on image data or document data sent from the computer 31.

Further, the controller 110 is electrically connected to a paper feed motor driving circuit 120*a* for driving the paper feed motor 122, a transport motor driving circuit 120*b* for driving the paper transport motor 123, a carriage motor driving circuit 120*c* for driving a carriage motor 124, a recording head driving circuit 120*d* for driving the recording head 4 (for ejecting the ink), a drive switching motor driving circuit 120*e* for driving the drive switching motor 22, a pump drive motor driving circuit 120*f* for driving the pump drive motor 23, and a release rod driving circuit 120*g* for driving a release rod drive section 24.

When the CPU 11 controls the respective driving circuits 120*a* to 120*g* according to various kinds of programs stored in the ROM 112 and the EEPROM 114, the objects to be driven are driven and controlled. As mentioned above, the paper feed roller 8 is driven by the rotation of the paper feed motor 122, and the transport roller 7*a* is driven by the rotation of the paper transport motor 123.

The controller 110 executes an ink withdrawal process for withdrawing the ink from the ink supply tube 11 and an ink introduction process (described in detail later) at predetermined timings.

[Explanation of Ink Withdrawal Process]

Based on the flowchart of FIG. 7, and FIGS. 9A to 9E, the following description will explain the ink withdrawal process to be executed by the controller 110.

Figure 7:
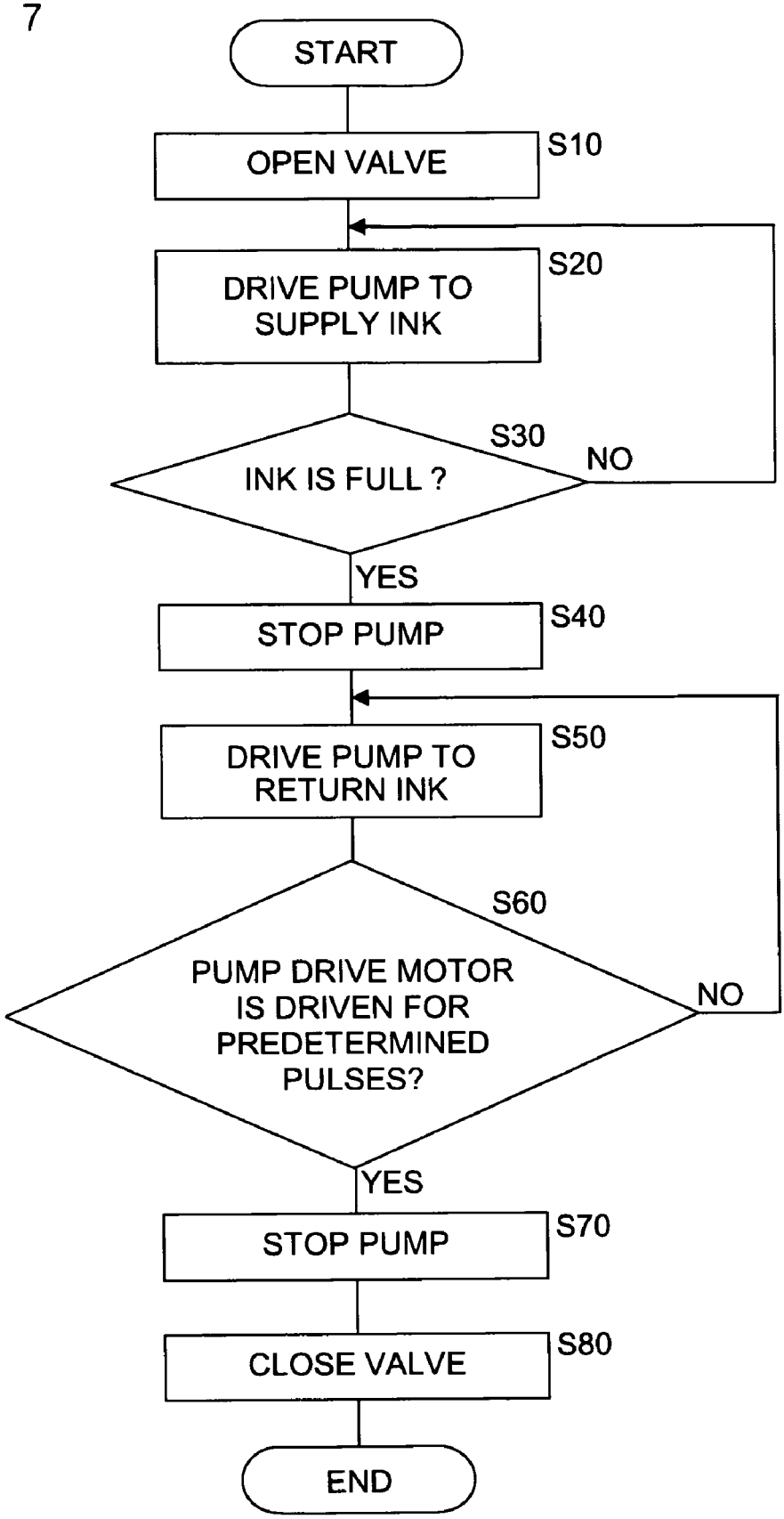
FIG. 7 is a flowchart showing the steps of an ink withdrawal process.

FIG. 7 is a flowchart showing the steps of the ink withdrawal process to be executed by the controller 110. The ink withdrawal process is a process of withdrawing the ink in the ink supply tube 11 into the ink cartridge 13 at a predetermined timing. The predetermined timing is as described in (1) to (4) below. (1) When the mode being selected changes to the facsimile mode from the printer motor or the copy mode according to an input entered by the user through the operation panel 6, etc., each of the color inks in Y, C, and M that are not used for image recording in the facsimile mode is withdrawn from the ink supply tube 11 into the ink cartridge 13. (2) When image recording is not performed for a predetermined time or more while the printer mode or the copy mode is selected, each of the color inks in Y, C, and M is withdrawn from the ink supply tube 11 into the ink cartridge 13. (3) When a setting is selected to perform monochrome image recording without using color inks in the printer mode or the copy mode according to an input entered by the user through the operation panel 6, etc., each of the color inks in Y, C, and M is withdrawn from the ink supply tube 11 into the ink cartridge 13. (4) When the inkjet recording apparatus 1 is turned into a standby state by turning off a soft switch of the inkjet recording apparatus 1 according to an input entered by the user through the operation panel 6, etc. (with a soft-key operation), each of the inks in the respective colors K, Y, C, and M, or each of the color inks in Y, C, and M, while leaving black ink (K), which is used frequently, in the ink supply tube 11, is withdrawn from the ink supply tube 11 into the ink cartridge 13.

Here, the soft switch means a mechanism for switching the system between an operating state (soft switch: ON) and a standby state (soft switch: OFF), and is different from a so-called main switch for opening and closing the main power source. In other words, even when the system is brought into a standby state by turning off the soft switch, power is supplied to the system itself, and it is possible to activate necessary mechanisms even when the system is on standby. Moreover, by bringing the system into a standby state by the soft switch, the system can be more quickly recovered to an operating state as compared to activating the system into an operating state after turning on the main switch.

First, in step 10 (hereinafter simply denoted as S10, and other steps will also be denoted in the same manner), the release rod drive section 24 (see FIG. 6) is controlled to raise the release rod 16 and open the valve section 15 corresponding to each ink color to be withdrawn. At this time, when the release rod 16 rises and pushes up the valve 15*b* from the valve closed state shown in FIG. 9A, the valve open state is obtained, that is, the sub-tank 14 turns into a state opened to the atmosphere (see FIG. 9B).

Figure 9A:
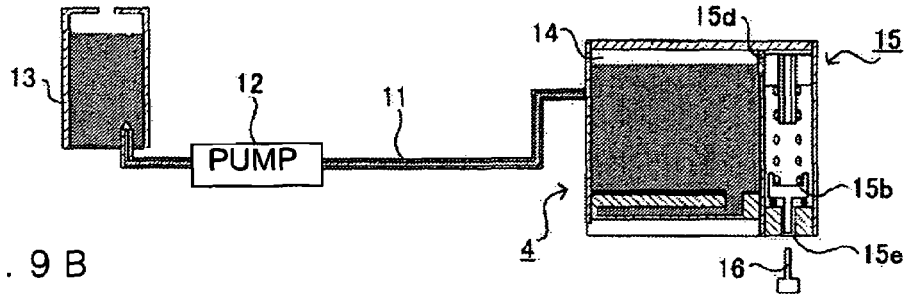
FIGS. 9A to 9E are views showing the operations of the respective sections in the ink withdrawal process.
Figure 9B:
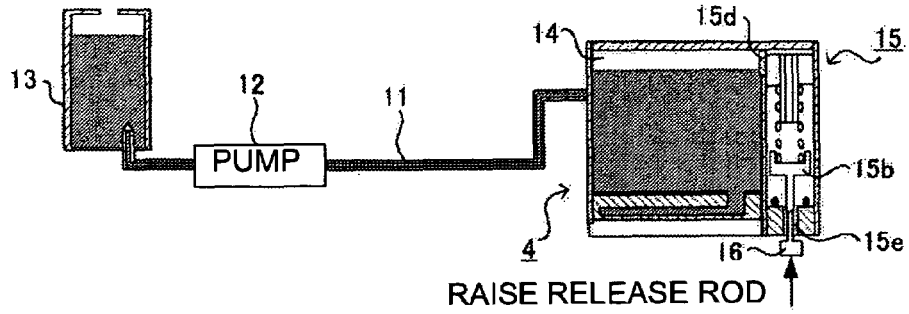
Figure 9C:
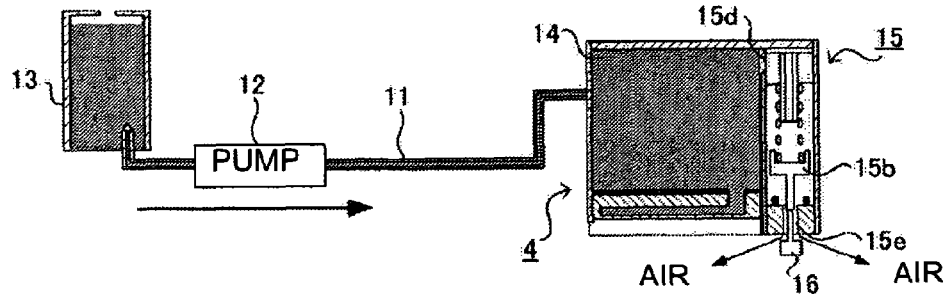

Next, in S20, the drive switching motor 22 and the pump drive motor 23 (see FIG. 6) are controlled to drive the pump 12 corresponding to each ink color to be withdrawn and feed the ink in the ink supply direction, so that the ink is supplied to the sub-tank 14 (hereinafter, driving the pump 12 in such a manner is also referred to as "supply-driving"). The rotation speed of the pump drive motor 23, etc. are controlled during the supply of the ink so that the ink is fed at such pressure (not higher than 3.5 kpa in this embodiments that a meniscus of the ink in the nozzle of the recording head 4 will not be broken. Here, as shown in FIG. 9C, with the supply of the ink into the sub-tank 14, the air in the sub-tank 14 permeates the gas permeable film 15*d*, is circulated in the valve section 15 and discharged from the air vent 15*e*, and thus the ink is promptly supplied. At this time, since the ink in the sub-tank 14 does not permeate the gas permeable film 15*d*, the ink will not leak into the valve section 15.

Subsequently, in S30, based on detection results from an optical sensor (not shown) provided for the recording head 4, a pressure sensor (not shown) provided for the ink supply tube 11, etc, a determination is made as to whether or not the sub-tank 14 has been filled up with the ink. Here, if a determination is made that the sub-tank 14 has not been filled up with the ink (S30: N), the controller 110 returns to the process of S20 and continues the supply driving of the pump 12. On the other hand, if a determination is made that the sub-tank 14 has been filled up with the ink (S30: Y), the pump 12 is stopped (S40).

Note that there is the following reason why filling up the sub-tank 14 once prior to withdrawing the ink from the ink supply tube 11 in S20 and S30. Specifically; in the case where the amount of the ink remaining in the sub-tank 14 is small when the ink was withdrawn from the ink supply tube 11, if the sub-tank 14 becomes empty due to some reason such as discharge of the ink in the sub-tank 14 by execution of a maintenance operation on the recording head 4 corresponding to the ink during image recording, the very small amount of remaining ink may dry and completely solidify in the nozzle, and may impair the ink ejection function of the recording head 4. In order to avoid such a circumstance, if the ink is withdrawn from the ink supply tube 11 by carrying out the step of returning a predetermined amount of ink to the ink cartridge 13 after filling up the sub-tank 14 once, a sufficient amount of ink will remain in the sub-tank 14 after the withdrawal of the ink. It is thus possible to prevent the ink in the sub-tank 14 from running out soon.

Figure 9D:
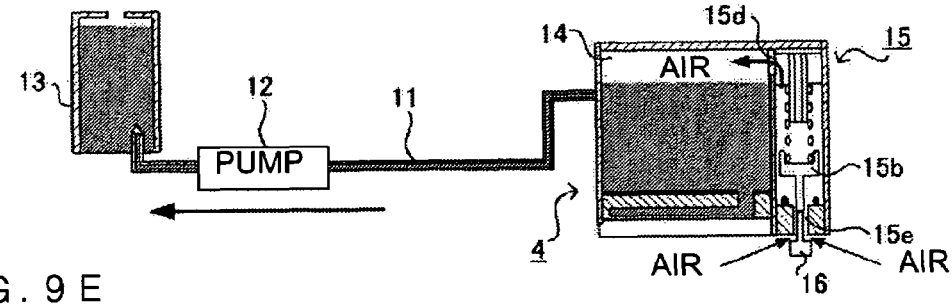

Next, in S50, the drive switching motor 22 and the pump drive motor 23 are controlled to drive the pump 12 in the opposite direction to the supply driving and feed the ink in the ink withdrawal direction, so that the ink is returned to the ink cartridge 13 (hereinafter, driving the pump 12 in such a manner is also referred to as "withdrawal-driving"). The rotation speed of the pump drive motor 23, etc. are controlled when withdrawing the ink so that the ink is fed at such pressure (not higher than 3.5 kpa in this embodiment) that a meniscus of the ink in the nozzle of the recording head 4 will not be broken. Here, as shown in FIG. 9D, with a decrease of the ink in the sub-tank 14, the air taken from the air vent 15*e* of the valve section 15 permeates the gas permeable film 15*d* and flows into the sub-tank 14, and thus the ink is promptly withdrawn.

Subsequently, in S60, a determination is made as to whether or not the pump drive motor 23 for driving the pump 12 was driven for predetermined pulses. Here, the predetermined pulses mean the amount of power supply pulses for driving the pump drive motor 23 for the number of rotations necessary for driving the pump 12 to feed the ink necessary for withdrawing the ink from the ink supply tube 11. The amount of power supply pulses is preset based on the capacity of the pump 12, the amount of ink needed to be fed, the gear ratio, etc.

In S60, if a determination is made that the pump drive motor 23 has not been driven for the predetermined pulses (that is, the predetermined amount of ink has not been supplied) (S60: N), the controller 110 returns to the process of step S50 and continues the withdrawal-driving of the pump 12. When the withdrawal-driving of the pump 12 is continued and consequently the liquid surface of the ink in the sub-tank 14 becomes lower than the joint position of the ink supply tube 11, the ink is withdrawn from the ink supply tube 11, and the ink supply tube 11 becomes empty. Then, in S60, if a determination is made that the pump drive motor 23 has been driven for the predetermined pulses (that is, a predetermined amount of the ink has been fed) (S60: Y), the pump 12 is stopped (S70).

Figure 9E:
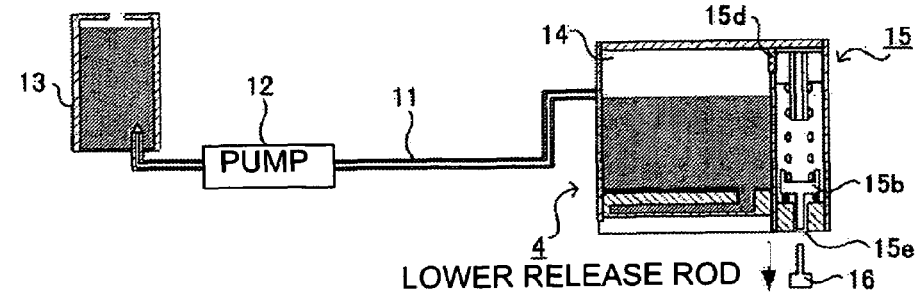

Next, in S80, the release rod drive section 24 is controlled to lower the release rod 16 and close the valve section 15 corresponding to an ink color to be withdrawn. At this time, as shown in FIG. 9E, when the release rod 16 is lowered from the valve open state, the valve 15*b* returns to the original position and turns into the valve close state, that is, the sub-tank 14 turns into a state closed to the atmosphere.

If a plurality of color inks are to be withdrawn, the above-mentioned process is repeated for each ink color.

[Explanation of Ink Introduction Process]

Referring to the flowchart of FIG. 8 and FIGS. 10A to 10D, the following description will explain the ink introduction process to be executed by the controller 110.

Figure 8:
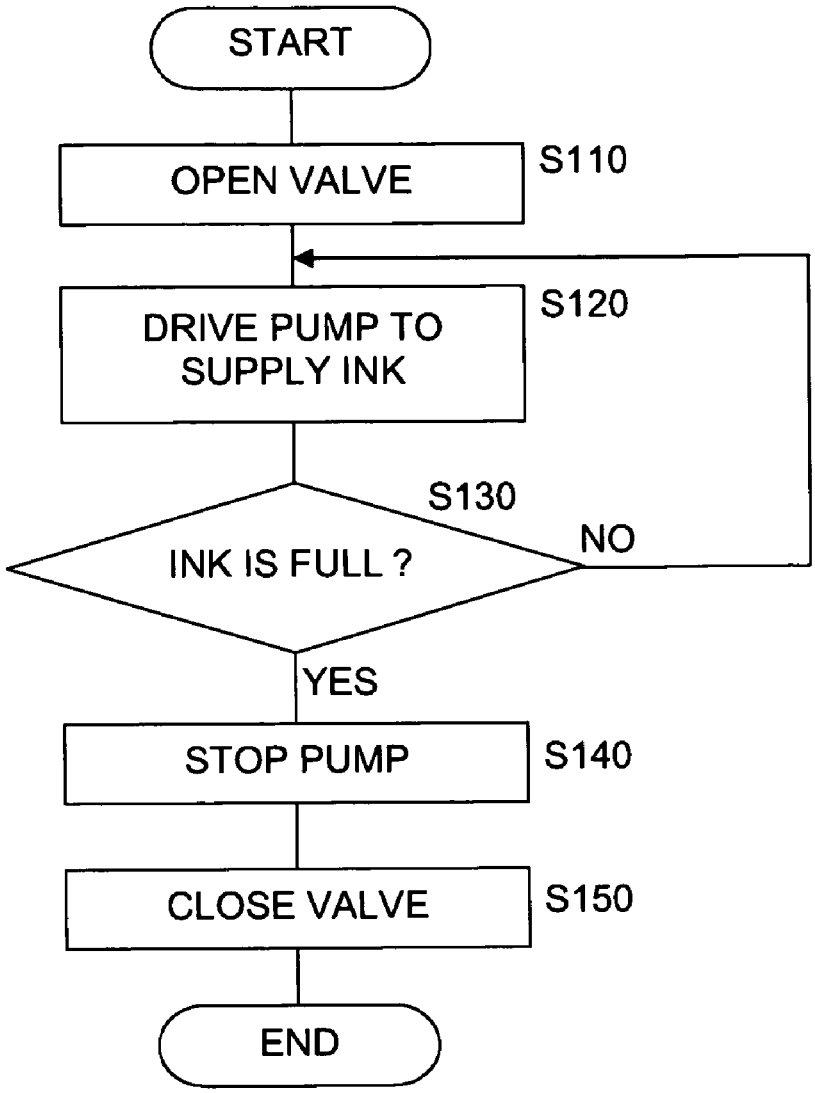
FIG. 8 is a flowchart showing the steps of an ink introduction process.

FIG. 8 is a flowchart showing the steps of the ink introduction process to be executed by the controller 110. The ink introduction process is the process of introducing the ink into the ink supply tube 11 and sub-tank 14 again when performing image recording using the withdrawn ink from a state in which the ink has been withdrawn from the ink supply tube 11 by the above-mentioned ink withdrawal process.

For example, in the case where the color inks in Y, C and M have been withdrawn, the respective color inks are introduced again when an instruction to execute color image recording is received. On the other hand, in the case where the inks in the respective colors K, Y, C and M have been withdrawn, only the K ink is introduced again when an instruction to execute monochrome image recording is received, or the inks in all the colors are introduced again when an instruction to execute color image recording is received. Alternatively, it may be possible to introduce the respective color inks again when the selected mode is switched to the printer mode from the state in which the color inks in Y, C and M were withdrawn when the facsimile mode was selected. Moreover, in a state in which the K ink was withdrawn, it may be possible to introduce the K ink again when the facsimile mode is selected.

First, in S110, the release rod drive section 24 (see FIG. 6) is controlled to raise the release rod 16 and open the valve section 15 corresponding to an ink color to be introduced. At this time, when the release rod 16 rises and pushes up the valve 15*b* from the valve closed state show in FIG. 10A, the valve is turned into an open state, that is the sub-tank 14 is turned into a state opened to the atmosphere (see FIG. 10B).

Figure 10A:
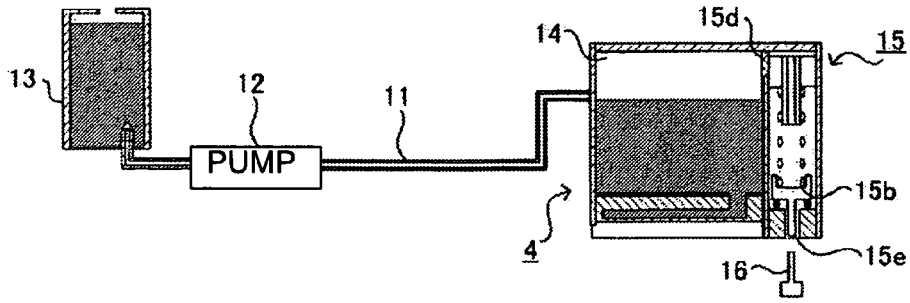
FIGS. 10A to 10D are views showing the operations of the respective sections in the ink introduction process.
Figure 10B:
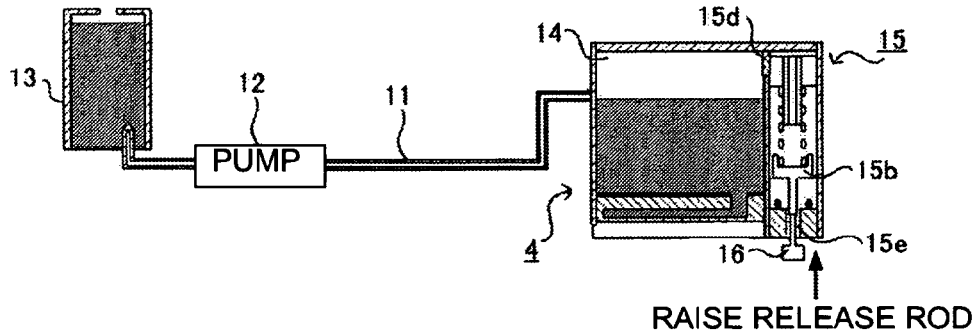
Figure 10C:
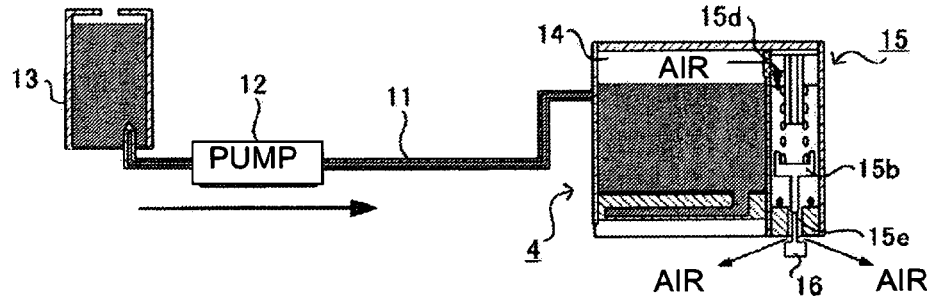

Next, in S120, the drive switching motor 22 and the pump drive motor 23 (see FIG. 6) are controlled to perform the supply-driving of the pump 12 corresponding to each ink color to be introduced, so that the ink is supplied to the sub-tank 14. Here, as shown in FIG. 10C, with the supply of the ink to the sub-tank 14, the air in the sub-tank 14 permeates the gas permeable film 15*d*, is circulated in the valve section 15 and discharged from the air vent 15*e*, and thus the ink is promptly supplied. At this time, since the ink in the sub-tank 14 does not permeate the gas permeable film 15*d*, the ink will not leak into the valve section 15.

Subsequently, in S130, based on detection results from the optical sensor (not shown) provided for the recording head 4, the pressure sensor (not shown) provided for the ink supply tube 11, etc, a determination is made as to whether or not the sub-tank 14 has been filled up with the ink. Here, if a determination is made that the sub-tank 14 has not been filled up with the ink (S130: N), the controller 110 returns to the process of S120 and continues the supply-driving of the pump 12. On the other hand, if a determination is made that the sub-tank 14 has been filled up with the ink (S130: Y), the pump 12 is stopped (S140). At this time, the sub-tank 14 is filled up with the ink, and the ink supply tube 11 is also filled up with the ink.

Figure 10D:
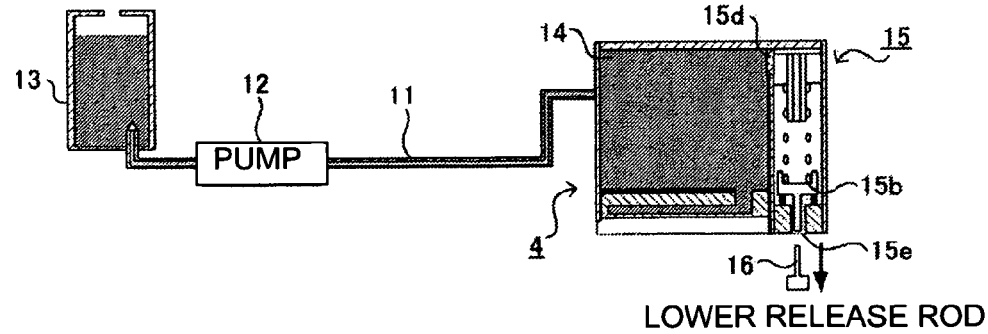

Next, in S150, the release rod drive section 24 is controlled to lower the release rod 16 and close the valve section 15 corresponding to an ink color to be introduced. At this time, as shown in FIG. 10D, when the release rod 16 is lowered from the valve open state, the valve 15*b* returns to the original position and turns into the valve close state, that is, the sub-tank 14 turns into a state closed to the atmosphere.

If a plurality of color inks are to be introduced, the above-mentioned process is repeated for each ink color.

Effects of this Embodiment

According to the inkjet recording apparatus 1 of this embodiment, the following effects are provided. Specifically, by withdrawing colors inks in Y, C and M that are not used for facsimile image recording (monochrome image recording) from the ink supply tubes 11 when the selected mode is switched to the facsimile mode, the respective-color inks will not stay in the ink supply tubes 11 in an uncertain period, such as a period of waiting for facsimile. It is therefore possible to prevent evaporation of the solvent in the ink from the ink supply tube 11, and it is possible to reduce the increase in the viscosity of the color ink. Moreover, even when the ink is discharged due to a maintenance operation on the recording head 4 during facsimile image recording, since the ink has been withdrawn from the ink supply tube 11, the ink will not be newly supplied to the recording head 4, and consequently it is possible to reduce the amount of the ink to be discarded.

Further, since the respective color inks are withdrawn when image recording is not performed for a long time in a state in which the printer mode or the color mode is selected, the color inks do not stay in the ink supply tubes 11 for a long time, and thus it is possible to reduce the increase in the viscosity of the inks.

When outputting a monochrome image in the printer mode or the copy mode, if the user selects not to use color inks, it is possible to withdraw the inks from the ink supply tubes 11 corresponding to the respective color inks. Therefore, for a user who rarely outputs color images, this structure is convenient because it is possible to reduce the increase in the viscosity of color inks and the amount of inks discarded by maintenance operations.

Moreover, since the respective color inks are withdrawn from the ink supply tubes 11 when turning into a standby state according to a soft switch, the inks do not stay in the ink supply tubes 11 when the system is on standby in which image recording is not performed. It is therefore possible to reduce the increase in the viscosity of the inks in the ink supply tubes 11.

Further, since the gas permeable film 15*d* provided in the joint section between the sub-tank 14 and the valve section 15 prevents the ink in the sub-tank 14 from being discharged together with the air from the valve section 15, it is possible to prevent wasteful discharge of the ink when supplying the ink to the sub-tank 14.

The corresponding relationship between the structures of the inkjet recording apparatus 1 of this embodiment and the structures recited in the claims are as follows. First, the ink cartridge 13 corresponds to an ink tank in the claims, and the sub-tank 14 corresponds to a sub-ink tank. The facsimile mode corresponds to a mono-color image recording mode, and the printer mode and the copy mode correspond to a multi-color image recording mode. Black ink corresponds to an ink in a specific color, and yellow, cyan and magenta inks correspond to inks in other colors. The pump 12, pump drive switching mechanism 17, drive switching motor 22, pump drive motor 23, drive switching motor driving circuit 120*e* and pump drive motor driving circuit 120*f* correspond to liquid feeding means. The valve section 15, release rod 16, release rod drive section 24 and release rod driving circuit 120*g* correspond to valve means, and the gas permeable film 15*d* corresponds to a selective permeable film.

The above description explains this embodiment, but this embodiment is not limited to the above-described embodiment, and can be implemented in various modes as long as it belongs to the technical scope of this embodiment. Specific examples will be described below.

(1) The increase in the viscosity of the ink in the ink supply tube 11 can be limited by withdrawing the ink from the ink supply tube 11. Therefore, it may be possible to reduce the amount of an ink to be discarded by a maintenance operation by not performing a maintenance operation for the recording head 4 corresponding to an ink when the ink is withdrawn, or by reducing the number of times the maintenance operation is performed.

(2) It is preferable to select whether or not to withdraw an ink from the ink supply tube 11 according to an input entered by the user through the operation panel 6. This structure is convenient because it is possible to select whether or not to withdraw an ink from the ink supply tube 11 according to a preference of the user. In other words, for example, for a user who mainly uses monochrome image recording and rarely uses color image recording, selecting to perform the withdrawal and introduction of inks has significant merit to reduce the increase in the viscosity of the inks. On the other hand, for a user who uses both monochrome image recording and color image recording quite frequently, selecting not to perform the withdrawal and introduction of inks has significant merit to save time spent on these operations.

(3) When the ink stored in the sub-tank 14 becomes a predetermined amount or less in a state in which the corresponding ink has been withdrawn from the ink supply tube 11, it may be possible to supply the ink from the ink cartridge 13 corresponding to the ink through the ink supply tube 11 to the sub-tank 14. Accordingly, it is possible to prevent the ink in the sub-tank 14 from running out due to a maintenance operation during image recording, and it is possible to prevent the ink ejection function of the recording head 4 from being impaired.

(4) It may be possible to provide a function for forcefully discharging the ink from the nozzle of the recording head 4 by the pump 12. In other words, with the pump 12, it is possible to realize a function for supplying the ink from the ink cartridge 13 to the ink supply tube 11 and sub tank 14, a function for withdrawing the ink from the ink sup ply tube 11 into the ink cartridge 13, and a function for forcefully discharging the ink from the nozzle of the recording head 4. More specifically, the feeding direction of the ink and pressure when feeding the ink are controlled by changing the rotation direction and rotation speed of the pump 12. In other words, when discharging the ink forcefully from the nozzle during a maintenance operation such as flushing or purging, the pump 12 is driven to feed the ink to the recording head 4 at a pressure exceeding a pressure that breaks a meniscus of the ink in the nozzle (at a pressure not lower than 3.5 kpa in the above described embodiment). Thus, by realizing a plurality of functions such as the supply, withdrawal and forceful discharge of the ink by a single pump, the number of components necessary for the mechanism for feeding the ink can be reduced, thereby contributing to a reduction in the size of the inkjet recording apparatus and the cost.

As this description may be embodied in several forms without departing from the spirit of essential characteristics thereof, this embodiment is therefore illustrative and not restrictive, since the scope is defined by the appended claims rather than by the description preceding them, and all changes that fall within metes and bounds of the claims or equivalence of such metes and bounds thereof are therefore intended to be embraced by the claims.

What is claimed is:

1. An inkjet recording apparatus, comprising:

a plurality of ink tanks for storing inks in a plurality of colors respectively;

a plurality of sub-ink tanks for storing the inks supplied from the ink tanks respectively;

a plurality of recording heads incorporating the sub-ink tanks respectively, and each for recording an image on a recording medium by ejecting the ink from a nozzle;

a plurality of ink supply tubes for connecting the ink tanks and the recording heads respectively;

a liquid feeding unit provided in a middle of the ink supply tubes and capable of feeding each ink in both of a direction of supplying each ink from each ink tank to each ink supply tube and each sub-ink tank and a direction of withdrawing each ink from each ink supply tube into each ink tank; and a controller capable of:

switching between a first mode in which image recording is performed using an ink including at least an ink in a first color of the inks in the plurality of colors, and a second mode in which image recording is performed using at least an ink in a second color of the inks in the plurality of colors but not using the ink in the first color;

in the second mode, causing the liquid feeding unit to withdraw the ink in the first color into the ink tank from the ink supply tube for supplying the ink in the first color, thereafter causing the recording head to start image recording; and in the first mode, causing the liquid feeding unit to introduce the ink in the first color from the ink tank into the ink supply tube for supplying the ink in the first color, thereafter causing the recording head to start image recording.

2. The inkjet recording apparatus according to claim 1, wherein a mono-color image recording mode for performing image recording using an ink in a specific color, or a multi-color image recording mode for performing image recording using the ink in the specific color and inks in other colors, is selectable, and said controller is further capable of causing the liquid feeding unit to withdraw the inks in other colors into the respective ink tanks from the respective ink supply tubes for supplying the inks in other colors at least when the mono-color image recording mode is selected, and causing the liquid feeding unit to introduce the inks in other colors into the respective ink supply tubes from the respective ink tanks when performing image recording in the multi-color image recording mode, thereafter causing the recording heads to start image recording.

3. The inkjet recording apparatus according to claim 2, wherein the mono-color image recording mode includes a facsimile mode for performing facsimile image recording, and the multi-color image recording mode includes at least either a printer mode for performing image recording as an output device for a computer, or a copy mode for copying an image read by a scanner.

4. The inkjet recording apparatus according to claim 3, wherein said controller is further capable of causing the liquid feeding unit to withdraw the inks in other colors from the respective ink supply tubes when image recording is not performed for a predetermined time or more while the multi-color image recording mode is selected.

5. The inkjet recording apparatus according to claim 3, wherein it is possible to select whether or not to use the inks in other colors in the multi-color image recording mode, and said controller is further capable of, when non-use of the inks in other colors in the multi-color image recording mode is selected, causing the recording head to perform image recording in the multi-color image recording mode in a state in which the inks in other colors have been withdrawn from the respective ink supply tubes by the liquid feeding unit.

6. The inkjet recording apparatus according to claim 2, wherein said controller is further capable of causing the liquid feeding unit to withdraw the inks in other colors from the respective ink supply tubes when the mode is changed from the multi-color image recording mode to the mono-color image recording mode.

7. The inkjet recording apparatus according to claim 1, wherein said controller is further capable of causing the liquid feeding unit to withdraw the inks from the ink supply tubes when the inkjet recording apparatus is changed into a standby state with a soft-key operation.

8. The inkjet recording apparatus according to claim 1, wherein a user is allowed to select whether or not to withdraw the ink from the ink supply tube.

9. The inkjet recording apparatus according to claim 1, wherein said controller is further capable of, when the amount of an ink stored in the sub-ink tank becomes a predetermined amount or less in a state in which the ink has been withdrawn from the ink supply tube by the liquid feeding unit, causing the liquid feeding unit to supply the ink from the ink tank corresponding to the ink through the ink supply tube to the sub-ink tank.

10. An inkjet recording apparatus, comprising:

a plurality of ink tanks for storing inks in a plurality of colors respectively;

a plurality of sub-ink tanks for storing the inks supplied from the ink tanks respectively;

a plurality of recording heads incorporating the sub-ink tanks respectively, and each for recording an image on a recording medium by ejecting the ink from a nozzle;

a plurality of ink supply tubes for connecting the ink tanks and the recording heads respectively;

a liquid feeding unit provided in a middle of the ink supply tubes and capable of feeding each ink in both of a direction of supplying each ink from each ink tank to each ink supply tube and each sub-ink tank and a direction of withdrawing each ink from each ink supply tube into each ink tank;

a controller capable of, when image recording using an ink in a color is not performed, causing the liquid feeding unit to withdraw the ink into the ink tank from the ink supply tube for supplying the ink, and, when image recording is to be performed using the ink, causing the liquid feeding unit to introduce the ink from the ink tank into the ink supply tube for supplying the ink, thereafter causing the recording head to start image recording; and a valve unit for opening the inside of the sub-ink tank to the atmosphere during an operation of withdrawing the ink from the ink supply tube into the ink tank by the liquid feeding unit, or an operation of introducing the ink from the ink tank into the ink supply tube, wherein the inside of the sub-ink tank and the valve unit are connected through a selective permeable film that permeates gases but does not permeate the ink.

11. The inkjet recording apparatus according to claim 10, wherein the ink is forcefully discharged from the nozzle of the recording head by the liquid feeding unit.

12. An inkjet recording apparatus, comprising:

a plurality of ink tanks for storing inks in a plurality of colors respectively;

a plurality of sub-ink tanks for storing the inks supplied from the ink tanks respectively;

a plurality of recording heads incorporating the sub-ink tanks respectively, and each for recording an image on a recording medium by ejecting the ink from a nozzle;

a plurality of ink supply tubes for connecting the ink tanks and the recording heads respectively;

liquid feeding means provided in a middle of the ink supply tubes and capable of feeding each ink in both of a direction of supplying each ink from each ink tank to each ink supply tube and each sub-ink tank and a direction of withdrawing each ink from each ink supply tube into each ink tank; and control means for:

switching between a first mode in which image recording is performed using an ink including at least an ink in a first color of the inks in the plurality of colors, and a second mode in which image recording is performed using at least an ink in a second color of the inks in the plurality of colors but not using the ink in the first color;

in the second mode, controlling the liquid feeding means to withdraw the ink in the first color into the ink tank from the ink supply tube for supplying the ink in the first color, thereafter causing the recording head to staff image recording; and in the first mode, controlling the liquid feeding means to introduce the ink in the first color from the ink tank into the ink supply tube for supplying the ink in the first color, thereafter controlling the recording head to start image recording.

13. The inkjet recording apparatus according to claim 12, wherein a mono-color image recording mode for performing image recording using an ink in a specific color, or a multi-color image recording mode for performing image recording using the ink in the specific color and inks in other colors, is selectable, and said-control means controls the liquid feeding means to withdraw the inks in other colors into the respective ink tanks from the respective ink supply tubes for supplying the inks in other colors at least when the mono-color image recording mode is selected, and controls the liquid feeding means to introduce the inks in other colors into the respective ink supply tubes from the respective ink tanks when performing image recording in the multi-color image recording mode, thereafter controlling the recording heads to start image recording.

14. The inkjet recording apparatus according to claim 13, wherein the mono-color image recording mode includes a facsimile mode for performing facsimile image recording, and the multi-color image recording mode includes at least either a printer mode for performing image recording as an output device for a computer, or a copy mode for copying an image read by a scanner.

15. The inkjet recording apparatus according to claim 14, wherein said control means controls the liquid feeding means to withdraw the inks in other colors from the respective ink supply tubes when image recording is not performed for a predetermined time or more while the multi-color image recording mode is selected.

16. The inkjet recording apparatus according to claim 14, wherein it is possible to select whether or not to use the inks in other colors in the multi-color image recording mode, and when non-use of the inks in other colors in the multi-color image recording mode is selected, said control means controls the recording head to perform image recording in the multi-color image recording mode in a state in which the inks in other colors have been withdrawn from the respective ink supply tubes by the liquid feeding means.

17. The inkjet recording apparatus according to claim 13, wherein said control means controls the liquid feeding means to withdraw the inks in other colors from the respective ink supply tubes when the mode is changed from the multi-color image recording mode to the mono-color image recording mode.

18. The inkjet recording apparatus according to claim 12, wherein said control means controls the liquid feeding means to withdraw the inks from the ink supply tubes when the inkjet recording apparatus is changed into a standby state with a soft-key operation.

19. The inkjet recording apparatus according to claim 12, wherein a user is allowed to select whether or not to withdraw the ink from the ink supply tube.

20. The inkjet recording apparatus according to claim 12, wherein when the amount of an ink stored in the sub-ink tank becomes a predetermined amount or less in a state in which the ink has been withdrawn from the ink supply tube by the liquid feeding means, said control means controls the liquid feeding means to supply the ink from the ink tank corresponding to the ink through the ink supply tube to the sub-ink tank.

21. An inkjet recording apparatus, comprising:

a plurality of ink tanks for storing inks in a plurality of colors respectively;

a plurality of sub-ink tanks for storing the inks supplied from the ink tanks respectively;

a plurality of recording heads incorporating the sub-ink tanks respectively, and each for recording an image on a recording medium by ejecting the ink from a nozzle;

a plurality of ink supply tubes for connecting the ink tanks and the recording heads respectively;

liquid feeding means provided in a middle of the ink supply tubes and capable of feeding each ink in both of a direction of supplying each ink from each ink tank to each ink supply tube and each sub-ink tank and a direction of withdrawing each ink from each ink supply tube into each ink tank;

control means for, when image recording using an ink in a color is not performed, controlling the liquid feeding means to withdraw the ink into the ink tank from the ink supply tube for supplying the ink, and, when image recording is to be performed using the ink, controlling the liquid feeding means to introduce the ink from the ink tank into the ink supply tube for supplying the ink, thereafter controlling the recording head to start image recording; and valve means for opening the inside of the sub-ink tank to the atmosphere during an operation of withdrawing the ink from the ink supply tube into the ink tank by the liquid feeding means, or an operation of introducing the ink from the ink tank into the ink supply tube, wherein the inside of the sub-ink tank and the valve means are connected through a selective permeable film that permeates gases but does not permeate the ink.

22. The inkjet recording apparatus according to claim 21, wherein the ink is forcefully discharged from the nozzle of the recording head by the liquid feeding means.

* * * * *